US005310318A

United States Patent [19]

Lammas et al.

[11] Patent Number: 5,310,318

[45] Date of Patent: May 10, 1994

[54] ASYMMETRIC AXIAL DOVETAIL AND ROTOR DISK

[75] Inventors: Andrew J. Lammas, Maineville; Nicholas J. Kray; Doug A. Finkhousen, both of Cincinnati, all of Ohio

[73] Assignee: General Electric Company, Cincinnati, Ohio

[21] Appl. No.: 95,231

[22] Filed: Jul. 21, 1993

[51] Int. Cl.[5] ..... F01D 5/30

[52] U.S. Cl. ..... 416/219 R

[58] Field of Search ..... 416/219 R, 220 R, 221, 416/193 A

[56] References Cited

U.S. PATENT DOCUMENTS

| | | | |
|---|---|---|---|
| Re. 33,954 | 6/1992 | Honda et al. | 416/219 R |
| 2,619,318 | 11/1952 | Schaer . | |
| 3,986,793 | 10/1976 | Warner et al. . | |
| 4,135,857 | 1/1979 | Pannone et al. | 416/219 R |
| 4,169,694 | 10/1979 | Sanday . | |
| 4,451,203 | 5/1984 | Langley . | |
| 4,460,315 | 7/1984 | Tseng et al. . | |
| 4,595,340 | 6/1986 | Klassen et al. . | |
| 4,621,979 | 11/1986 | Zipps et al. . | |
| 4,767,274 | 8/1988 | Walter . | |
| 5,067,876 | 11/1991 | Moreman, III . | |

FOREIGN PATENT DOCUMENTS

| | | | |
|---|---|---|---|
| 1953709 | 4/1970 | Fed. Rep. of Germany | 416/219 R |
| 0989042 | 9/1951 | France | 416/219 R |
| 0813144 | 5/1959 | United Kingdom | 416/219 R |

*Primary Examiner*—Edward K. Look
*Assistant Examiner*—Christopher Verdier
*Attorney, Agent, or Firm*—Jerome C. Squillaro; Nathan D. Herkamp

[57] ABSTRACT

A rotor disk includes a rim with axially spaced apart forward and aft ends, with the aft end having a larger diameter than the forward end. The rim includes a plurality of straight dovetail slots defining dovetail posts therebetween. Each dovetail post includes a pair of lobes, a neck, and first and second pressure faces facing radially inwardly from the lobes. The first and second pressure faces vary in radial height therebetween from a first magnitude at the rim aft end to a second and smaller magnitude at the rim forward end to shift a portion of the bending loads from the dovetail post at the rim forward end to the dovetail post at the larger rim aft end.

12 Claims, 5 Drawing Sheets

ASYMMETRIC AXIAL DOVETAIL AND ROTOR DISK

The present invention relates generally to gas turbine engines, and, more specifically, to a compressor rotor blade and disk having sloped and skewed axial dovetails.

BACKGROUND OF THE INVENTION

A conventional gas turbine engine includes various rotor blades in the fan, compressor, and turbine sections thereof which are removably mounted to respective rotor disks. Each of the rotor blades includes a retention dovetail at the radially inner end thereof which may either be an axial-entry dovetail or a circumferential-entry dovetail. In axial-entry dovetails, the rotor disk includes a plurality of circumferentially spaced apart, axially extending dovetail slots for slidably receiving the blade dovetails for retention therein. And, for the circumferential-entry dovetails, the rotor disk includes a single circumferentially extending dovetail slot which circumferentially slidably receives the complementary dovetails for retention therein. In the axial-entry rotor disk the dovetail slots define a plurality of circumferentially spaced apart dovetail posts which carry the centrifugal loads from the blades; and in the circumferential-entry rotor disk only two axially spaced apart and annular dovetail posts are defined by the circumferentially extending single dovetail slot therebetween.

In view of the structural differences in axial dovetails and circumferential dovetails, the corresponding rotor disks are designed differently. Axial dovetails in one of their simplest configurations include a pair of lobes in a symmetrical dovetail configuration which is straight in the axial direction and configured for retention in a complementary dovetail slot in the rotor disk which is disposed parallel to the axial centerline or rotation axis of the rotor disk without slope in a vertical plane extending radially through the axial centerline axis, and parallel to the centerline axis without skew in a top or plan view looking along the circumference of the rotor disk.

In another conventional configuration, the dovetail slots in the rotor disk may be skewed or inclined relative to the centerline axis of the rotor disk in the top, plan view which is referred to as skew, while also being parallel to the centerline axis in the vertical view without slope. The dovetail slot is again straight, and the blade dovetail is similarly straight and configured for retention therein.

And, in yet another configuration, the dovetail slots in the rotor disk are both skewed and sloped, with inclination thereof both in the plan view along the circumference of the rotor disk, i.e. skew, and in the vertical sectional view, i.e. slope, relative to the centerline axis. The corresponding blade dovetail is again straight and configured for retention in the skewed and sloped dovetail slots. This configuration is primarily used in gas turbine engine compressors at the stage-one position thereof with a relatively high axial slope of the outer rim of the rotor disk for improved aerodynamic performance. The blade dovetails typically have corresponding slope in order to be axially retained therein without excess weight. And dovetail skew is provided in order to better align the twisted airfoil with its dovetail to reduce the stresses therein due to centrifugal force of the blades during operation.

More specifically, a typical rotor disk includes an outer rim which contains the dovetail slots for retaining the rotor blades thereto, with an integral and thinner annular web extending radially inwardly therefrom, followed in turn radially inwardly by an axially thicker hub. This provides a relatively low weight and structurally efficient rotor disk effective for carrying the substantial centrifugally generated loads from the blades within acceptable stress limits for providing a useful life of the disk during operation. Axially sloping the disk rim provides a smaller circumference at the forward end of the rim which has a smaller diameter, with a relatively larger circumference at the aft end of the rim which has a larger diameter. In high solidity compressor blade configurations, the number of compressor blades on the disk is made as large as possible for aerodynamic reasons. However, since the forward end of the blade rim has a smaller circumference than the aft end thereof, the blades are spaced closer together at the forward end than at the aft end, with the dovetail posts in the blade rim defined by the dovetail slots being circumferentially thinner at the rim forward end than at the rim aft end. The centrifugal loads generated by the blades during operation therefore create higher reaction stresses in the dovetail posts at the forward end thereof than at the aft end thereof.

Furthermore, since typical blade dovetails are straight for allowing economical fabrication of the corresponding dovetail slots by using linearly translated manufacturing cutting broaches, such broaches when used to form the skewed dovetail slots in the disk rim necessarily vary the radial configuration of the dovetail posts. This is better appreciated by recognizing that a straight dovetail slot extending axially through a disk rim without either slope or skew results in a constant configuration dovetail post. However, by skewing the dovetail slot it necessarily extends also circumferentially around the circumference or curvature of the rim which therefore varies the configuration of the corresponding dovetail posts. With the addition of slope to the dovetail slot, the configuration of the resulting dovetail posts is yet further affected.

Accordingly, in a skewed-only or skewed and sloped dovetail slot configuration, the resulting reaction stresses in the dovetail posts becomes a more complex design problem which must be resolved in order to obtain acceptable levels of centrifugally induced stresses with a suitable useful life of the rotor disk.

For example, in a rotor disk design without slope or skew the reaction forces carried through each dovetail post from the corresponding blade dovetails are symmetrical and intersect each other along the radial centerline axis of the dovetail posts and therefore create primarily tensile stresses in the neck portion of the dovetail post without bending stresses therein.

However, in the skewed design without slope, only the axial center section of the rotor disk experiences no bending of the disk post necks. Both axially forwardly and axially rearwardly from the center section, the angles of inclination of the resultant reaction forces acting on the opposing lobes of each dovetail post are no longer symmetrical but intersect each other to either circumferential side of the radial centerline axis of the dovetail post thus effecting a bending moment which induces bending stress in the dovetail post neck. However, the direction of the reaction bending moment has one sense axially forward from the center of the disk, and an opposite or negative sense relative thereto in the axially rearward direction from the center of the disk rim which effectively balance each other out with substantially equal maximum values of bending stress in the respective portions of the disk post neck.

In the skewed and sloped configuration, the resultant reaction loads carried by the opposing lobes of each dovetail post are again not symmetrical and therefore induce bending stresses in the dovetail post necks, and are not symmetrical without bending at the center of the disk rim as in the skewed-only configuration which therefore results in an unbalanced configuration with a maximum bending stress occurring in the dovetail posts adjacent the forward end of the disk rim having the minimum diameter, with reduced bending stresses occurring at the aft end of the disk rim having the largest diameter. Since the forward, smaller diameter end of the disk rim as compared to the aft, larger diameter end of the disk rim has less material for carrying the centrifugal loads, the stresses thereat are increased which decreases the useful life of the rotor disk.

SUMMARY OF THE INVENTION

A rotor disk includes a rim with axially spaced apart forward and aft ends, with the aft end having a larger diameter than the forward end. The rim includes a plurality of straight dovetail slots defining dovetail posts therebetween. Each dovetail post includes a pair of lobes, a neck, and first and second pressure faces facing radially inwardly from the lobes. The first and second pressure faces vary in radial height therebetween from a first magnitude at the rim aft end to a second and smaller magnitude at the rim forward end to shift a portion of the bending loads from the dovetail post at the rim forward end to the dovetail post at the larger rim aft end.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
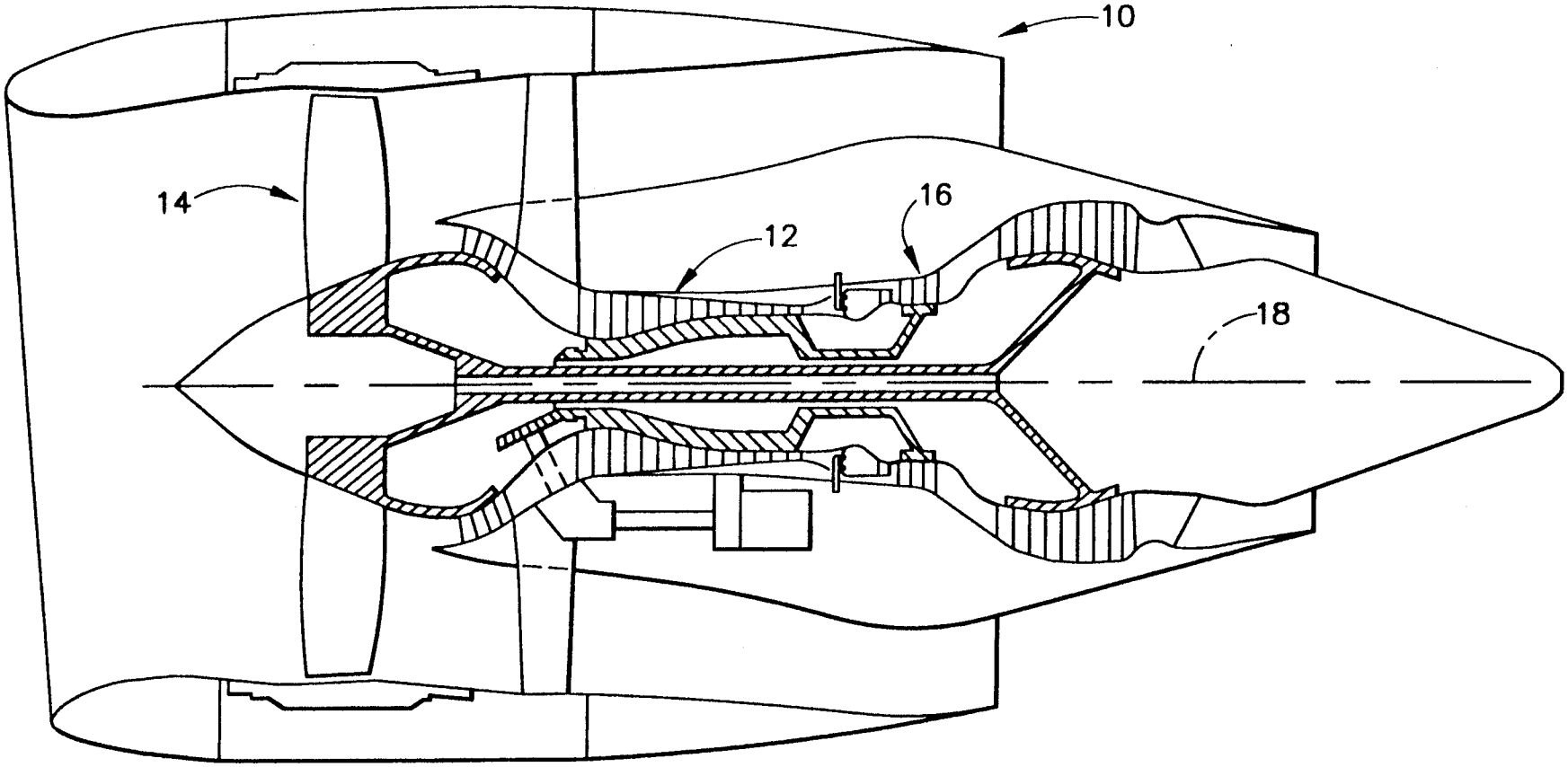
FIG. 1 is a schematic longitudinal centerline, partly sectional view of an exemplary turbofan gas turbine engine having a compressor with a rotor disk and blades in accordance with one embodiment of the present invention.

Illustrated schematically in FIG. 1 is an exemplary turbofan gas turbine engine 10 having a high pressure axial compressor 12 spaced axially downstream from a conventional fan 14 and powered through a suitable shaft by a conventional high pressure turbine 16 for rotating the compressor 12 about a longitudinal or axial centerline axis 18.

Figure 2:
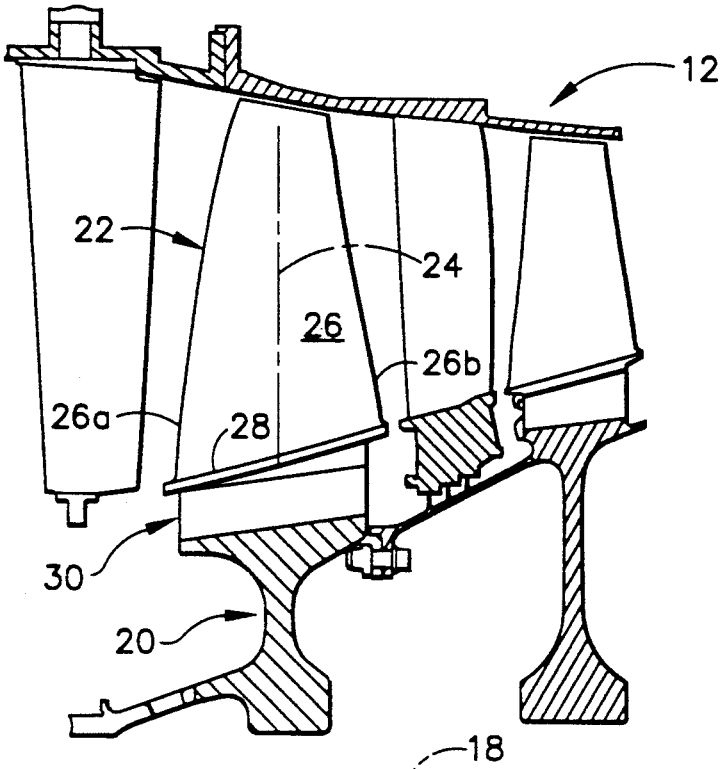
FIG. 2 is an enlarged longitudinal, partly sectional view of a portion of the compressor illustrated in FIG. 1 showing a stage-one compressor blade joined to its rotor disk in accordance with the present invention.

The first stage of the compressor 12 is illustrated in more particularly in FIG. 2 and includes an annular rotor disk 20 disposed coaxially with the centerline axis 18 and a plurality of circumferentially spaced apart stage-one compressor rotor blades 22 extending radially outwardly therefrom and removably fixedly joined thereto in accordance with one embodiment of the present invention.

Each blade 22 has a conventional longitudinal centerline axis 24, or stacking axis, which typically extends radially outwardly from and perpendicularly to the axial centerline axis 18. Each blade 22 includes an airfoil 26 having a leading edge **26*a* for first receiving airflow thereover, and a trailing edge 26*b* from which the airflow continues flow in the downstream direction. The blade 22 also typically includes a platform 28 which provides a portion of the radially inner boundary for the airflow over the airfoils 26, and an integral dovetail 30 extends integrally and radially inwardly from the airfoil 26 at the platform 28 and is configured for axial entry into the rotor disk 20 in accordance with the present invention. One of the blades 22 is illustrated in more particularity in FIG. 3 as configured for retention in the rotor disk 20 illustrated in more particularity in FIG. 4**.

Figure 4:
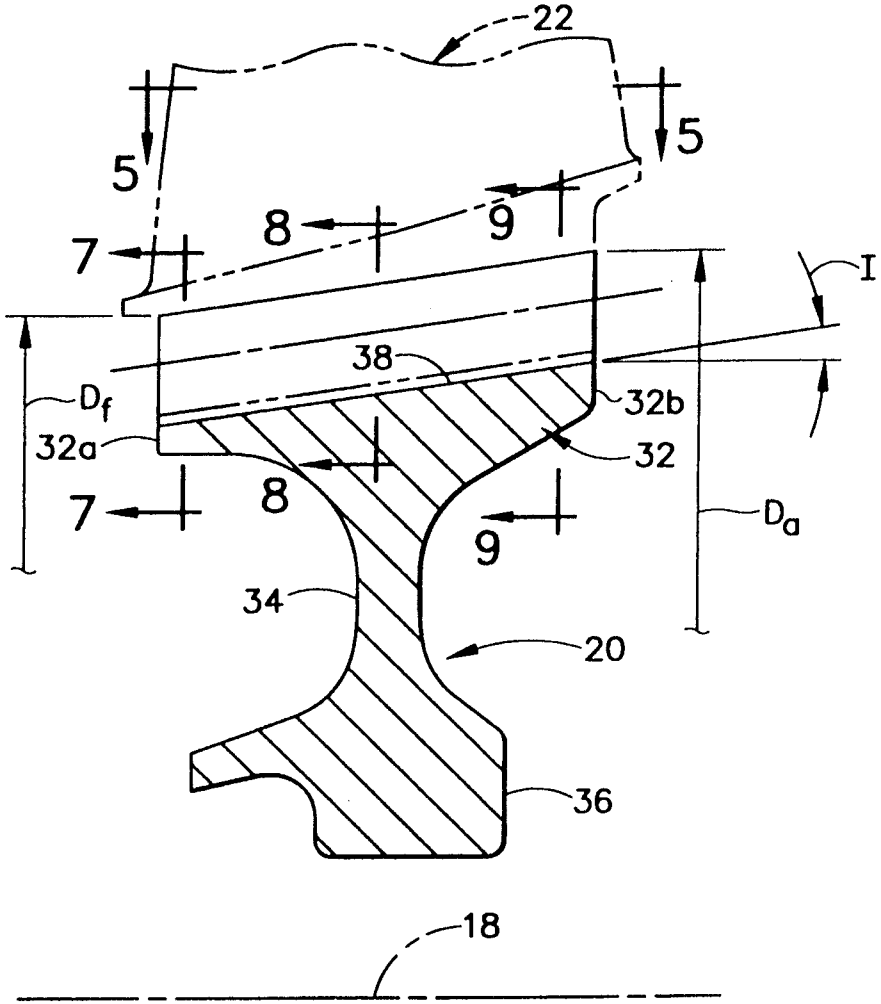
FIG. 4 is an enlarged, elevational sectional view of the stage-one rotor disk illustrated in FIG. 2 showing an exemplary axial-entry dovetail slot in a rim thereof.

Referring to FIG. 4, the rotor disk 20 includes an annular rim 32 at its perimeter which is disposed coaxially with the centerline axis 18 and has axially spaced apart forward and aft ends **32*a*, 32*b*. An integral thinner annular web 34 extends radially inwardly from the rim 32 followed in turn by a thicker annular hub 36. In the embodiment illustrated in FIG. 4, the rim 32 is sloped radially outwardly for aerodynamic reasons as is conventionally known, with the aft end 32*b* having an outer diameter $D_a$ which is larger than an outer diameter $D_f$ of the forward end 32*a***.

Figure 5:
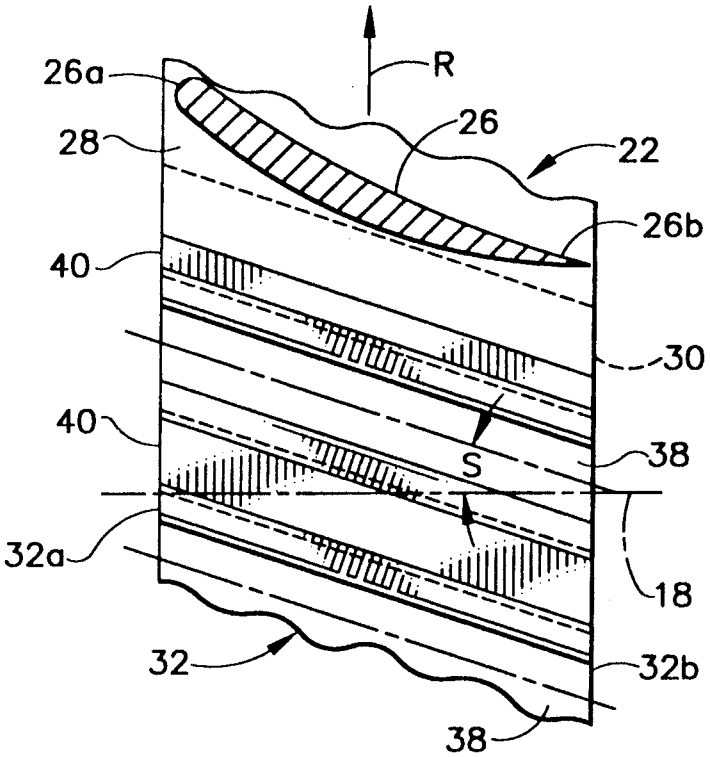
FIG. 5 is a top or plan view of a portion of the stage-one blades and rotor disk illustrated in FIG. 4 and taken along line 5—5.

As shown in FIG. 5, the rim 32 includes a plurality of circumferentially spaced apart, axially extending straight dovetail slots 38 for axially receiving and retaining therein the complementary dovetails 30 of the rotor blades 22. FIG. 5 illustrates an exemplary one of the rotor blades 22 mounted to the rim 32 with two adjacent ones of the slots 38 remaining empty for clarity of presentation. The slots 38 are preferably formed by conventional broach machining and define a plurality of circumferentially spaced apart and axially extending dovetail posts 40 which remain after the material is removed from the slot 38 during manufacturing. As shown in FIG. 5, the disk and its rim 32 rotate in the direction R with the airfoil leading edge 26*a* first receiving airflow which is compressed by the airfoil 26 and then discharged from its trailing edge 26*b*.

An exemplary one of the dovetail posts 40 in accordance with the present invention is illustrated in more particularly in FIG. 6, with each post 40 including a radially outer top 42 and a pair of circumferentially, oppositely extending lobes 44 defining a maximum circumferential width LW of the post 40 which varies at each axial plane perpendicular to the centerline axis 18 as further described below. Each post 40 further includes a circumferential neck 46 disposed radially below the lobes 44 which defines a minimum circumferential width NW of the post 40 where it blends with the remainder of the rim 32. As illustrated on the left side of FIG. 6, the post 40 includes a first pressure face 48 facing radially inwardly from a respective, leftmost one of the lobes 44 to the neck 46 which is on a first circumferential side, i.e. left side, of the post 40 for reacting force from the dovetail 30 (not shown in FIG. 6). A second pressure face 50 faces radially inwardly from the other, rightmost, one of the lobes 44 to the neck 46 on a second, opposite circumferential side of the post 40 for reacting force from the dovetail 30 (not shown in FIG. 6). In the embodiment illustrated in FIG. 6 with the rim 32 rotating in a clockwise direction as indicated by the arrow labeled R, the second pressure face 50 leads the first pressure face 48 in the direction of rotation.

Figure 3:
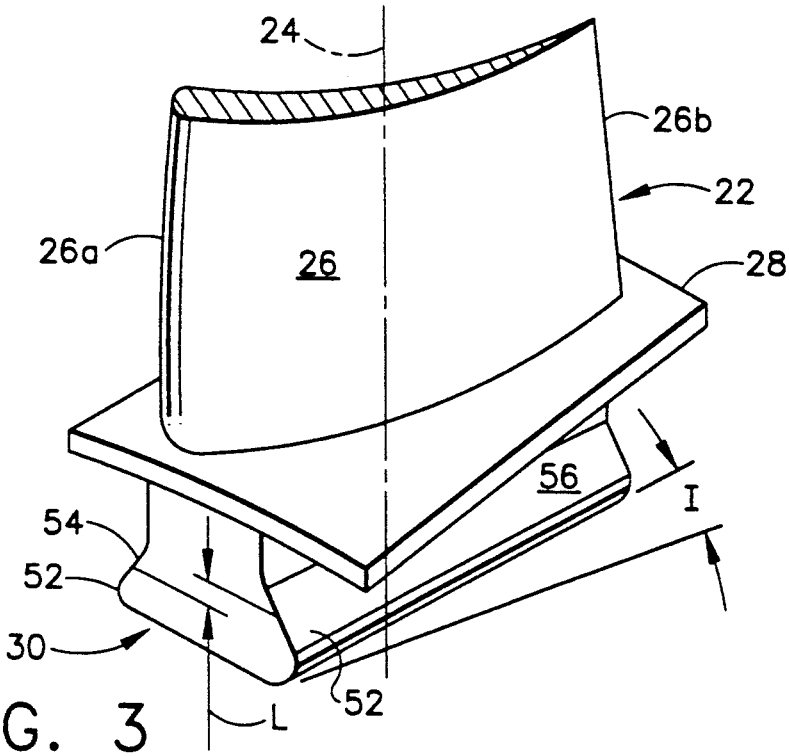
FIG. 3 is a perspective view of a portion of an exemplary one of the compressor rotor blades illustrated in FIG. 2 having an asymmetric dovetail in accordance with one embodiment of the present invention.

In accordance with the present invention, the first and second pressure faces 48, 50 vary in radial height H therebetween from a first magnitude at the rim aft end 32*b* to a second magnitude at the rim forward end 32*a*, with the second magnitude being less than the first magnitude. In this way, the dovetail post is asymmetric, and the complementary dovetail 30 is also asymmetric. But, whereas the dovetail 30 as illustrated in FIG. 3 is straight with a substantially constant configuration, the dovetail posts 40 are straight but with varying configurations.

More specifically and referring again to FIGS. 4 and 5, each of the dovetail slots 38 is axially sloped at an inclination angle I as shown in FIG. 4 from the rim forward end 32*a* to the rim aft end 32*b*, and circumferentially skewed at an inclination angle S as illustrated in FIG. 5, with the slot 38 adjacent the airfoil leading edge 26*a* at the rim forward end 32*a* leading the slot 38 adjacent the airfoil trailing edge 26*b* at the rim aft end 32*b*. Dovetail slot slope and skew are conventionally known with the slope inclination angle I illustrated in FIG. 4 being conventionally selected with the increasing diameter of the rim 32 from its smallest diameter $D_f$ at its forward end to the largest diameter $D_a$ at its aft end, and with the inclination angle I being in a vertical or radial plane and measured relative to the centerline axis 18. The skew angle S illustrated in FIG. 5 is also conventional and aligns the dovetail 30 so that the airfoil leading edge 26*a* is circumferentially ahead of the trailing edge 26*b* in the direction of rotation R illustrated, with the skew angle S also being measured relative to the centerline axis 18 in the plan or circumferential view illustrated in FIG. 5.

Figure 8:
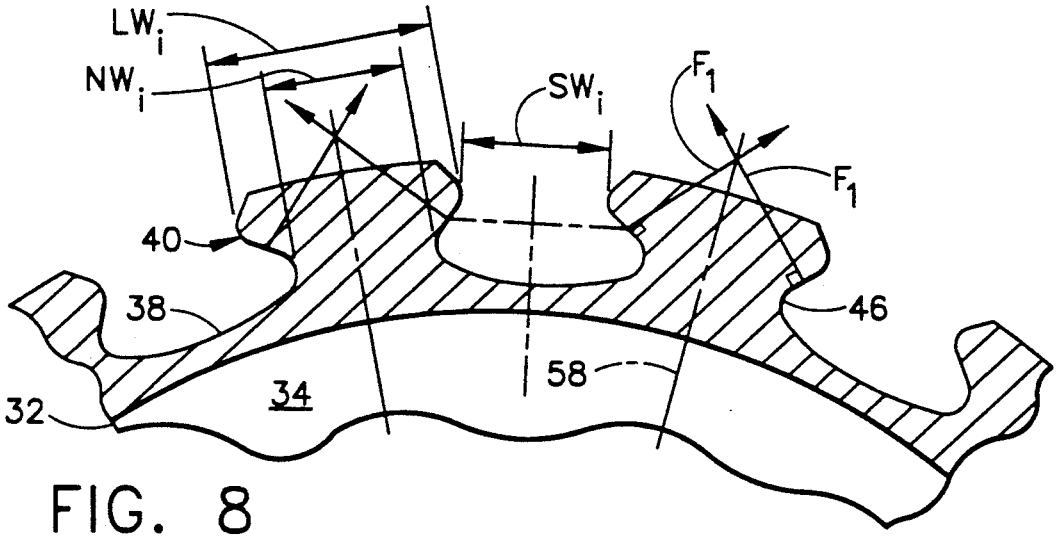
FIG. 8 is a radial sectional view of a portion of the stage-one blades and disk illustrated in FIG. 4 and taken along line 8—8 looking axially forwardly.
Figure 9:
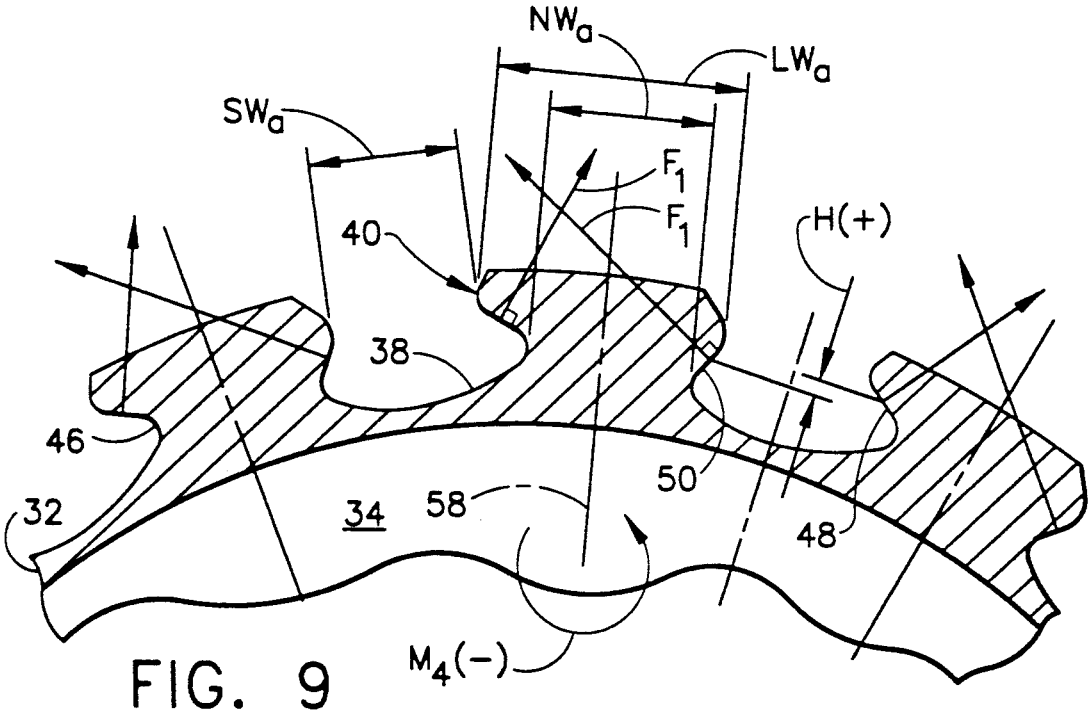
FIG. 9 is a radial sectional view of a portion of the stage-one blades and disk illustrated in FIG. 4 and taken along line 9—9 looking axially forwardly.

Since the dovetail slots 38 are both skewed and sloped, a conventional straight broach for obtaining a constant dovetail slot configuration will necessarily vary the configuration of the dovetail posts as described above in the Background section. More specifically, FIGS. 7–9 illustrate three exemplary radially extending sections at axially spaced apart planes through the disk rim 32 illustrated in FIG. 4, with FIG. 7 illustrating a section through the forward end 32*a* of the rim 32, FIG. 8 illustrating an intermediate or center section through the rim 32, and FIG. 9 illustrating a section through the aft end 32*b* of the rim 32.

Figure 6:
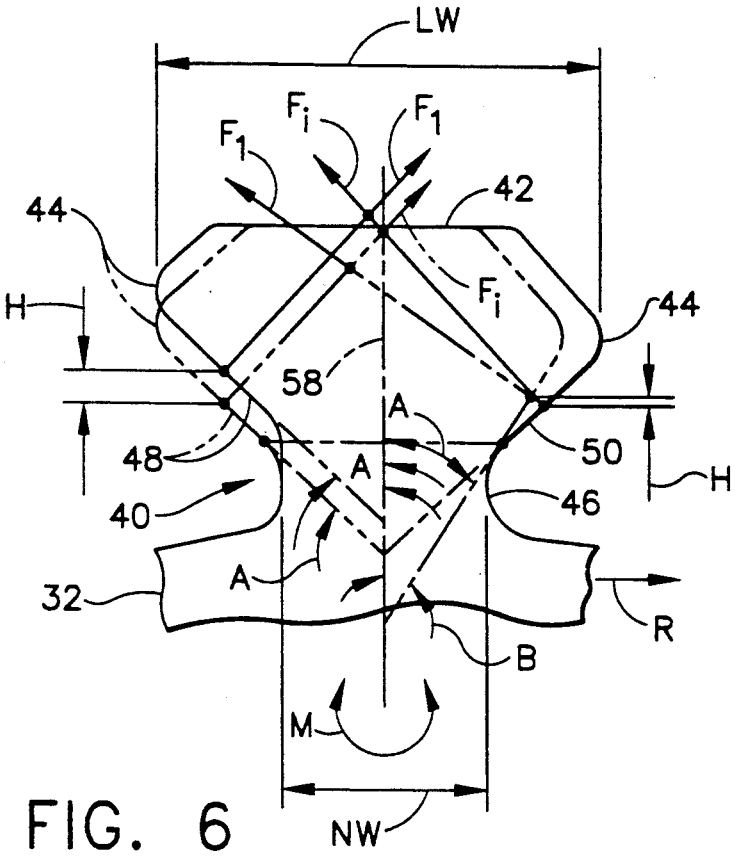
FIG. 6 is an enlarged one of the dovetail posts illustrated in FIGS. 7–9 for showing generically the asymmetric dovetail post lobes in accordance with the present invention.
Figure 7:
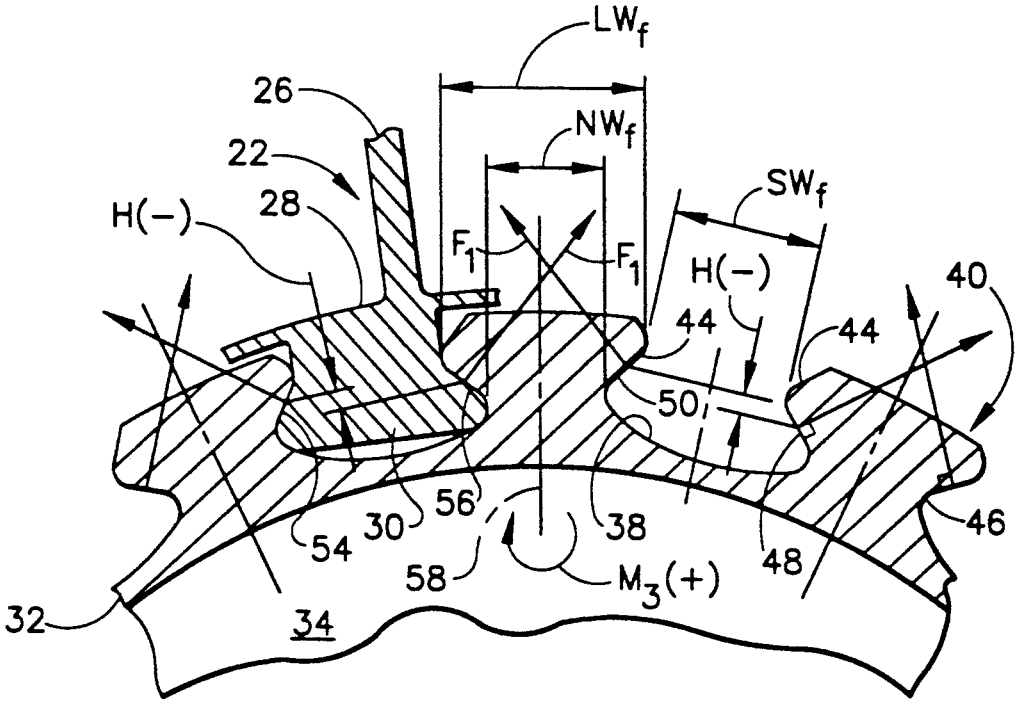
FIG. 7 is a radial sectional view of a portion of the stage-one blades and disk illustrated in FIG. 4 and taken along line 7—7 looking axially forwardly.

Referring again to FIG. 3, each dovetail 30 has a pair of circumferentially extending lobes 52 with corresponding upwardly facing pressure faces 54, 56 for transmitting centrifugal loads to the rotor disk 20 as illustrated in FIG. 7 for example. The dovetail 30 is straight from adjacent the airfoil leading edge 26*a* to adjacent the airfoil trailing edge 26*b*, and has a substantially constant configuration of the lobes 52 therebetween with a constant width between the lobes 52. Correspondingly, the slot width, e.g. $SW_f$, between oppositely facing ones of the disk post lobes 44 defining the dovetail slot 38 is constant in dimension from the rim forward end 32*a* to the rim aft end 32*b*. Since the rim 32 is sloped and the circumferential widths of the dovetails 30 and the widths SW of the dovetail slots 38 are constant, the circumferential widths of the dovetail neck NW as illustrated in FIG. 6 and the circumferential width LW of each post 40 between the respective dovetail lobes 44 are smaller at the rim forward end 32*a* than at the rim aft end 32*b*. The respective widths of the neck 46 and the lobes 44, i.e. NW and LW, are shown in FIGS. 7–9 with the values increasing from $NW_f$, $LW_f$ at the rim forward end 32*a*, to the intermediate or center section illustrated in FIG. 8 having values $NW_i$, $LW_i$, to yet further larger values adjacent the rim aft end 32*b* as shown in FIG. 9 with values $NW_a$, $LW_a$. Also illustrated in FIGS. 7–9 is the constant width between opposing lobes 44 defining the dovetail slots 38 wherein the respective widths, i.e. $SW_f$, $SW_i$, and $SW_a$, are equal to each other.

As illustrated in FIGS. 3 and 6, the respective pressure faces 48, 50 of the dovetail posts 40 and pressure faces 54, 56 of the dovetail 30 are preferably substantially flat and complementary to each other with each having a respective axially extending resultant line of contact for carrying centrifugal forces from the dovetail 30 into the adjacent pair of dovetail posts 40. As shown in FIG. 3, the pair of dovetail pressure faces 54, 56 are longitudinally or radially spaced apart from each other at a predetermined distance L which is preselected for providing the varying radial height H between the pressure faces 48, 50 of the dovetail posts 40, which different heights L and H may be measured from the respective resultant lines of contact. As shown in phantom in the left side of FIG. 6 and in solid line on the right side of FIG. 6, a conventional symmetric dovetail post would have no radial height difference between the respective pressure faces 48, 50.

However, in accordance with the present invention, the first pressure face 48 may be displaced in radial height H from the second pressure face 50 at the respective lines of contact thereof for preferentially effecting varying bending moments in each dovetail post 40 from the rim forward end 32*a* to the rim aft end 32*b* to preferentially balance the reaction loads for decreasing the maximum bending stress in the dovetail post neck 46 adjacent the rim forward end 32*a* while increasing the bending stress in the neck 46 adjacent the rim aft end 32*b*. Since the dovetail post 40 has a larger neck width $NW_a$ at the rim aft end 32*b* as illustrated in FIG. 9 than the width $NW_f$ at the rim forward end 32a illustrated in FIG. 7, the absolute value or magnitude of the bending stress at the post aft end is not raised greater than at its forward end but merely increased while significantly decreasing the absolute value thereof at the small diameter at the rim forward end 32a.

Figure 10:
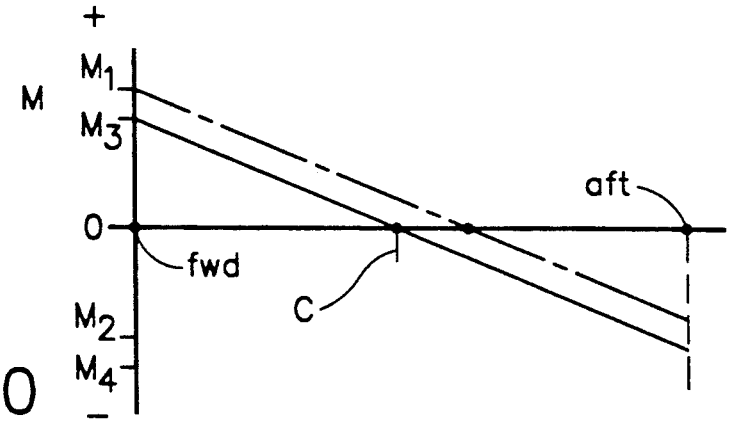
FIG. 10 is a graph plotting axial position on the abscissa between the forward and aft ends of the rotor disk illustrated in FIG. 4, and on the ordinate reaction bending moments in the neck of the disk post in phantom line for a symmetrical conventional dovetail and slot, and in solid line for an asymmetric dovetail and slot in accordance with the present invention.

The invention may be more readily understood by examining the moment graph illustrated in FIG. 10 which plots reaction bending moments on the dovetail post necks 46 as a function of axial position from the rim forward end 32a at the left side of the graph, i.e. fwd, to the center section, i.e. C, and to the rim aft end 32b at the right side of the graph, i.e. aft. FIG. 10 is based on the force diagrams illustrated generically in FIG. 6 and specifically in FIGS. 7-9. In FIG. 6, the initial reaction forces $F_i$ from a conventional symmetrical dovetail post intersect each other along the post radial centerline axis 58 and therefore result in a zero magnitude of bending moment, designated M, at the post neck 46. However, by radially displacing the first and second pressure faces 48, 50 by the distance H illustrated on the lefthand side of FIG. 6, the resulting reaction force is designated $F_1$ and intersects the opposing force vector $F_i$ to the left side of the post centerline axis 58 thusly creating a bending moment M which creates bending stresses in the neck 46.

FIG. 7 illustrates a relative negative height differential H (−) between the first and second pressure faces 48, 50 which causes the resultant reaction forces $F_1$ to intersect each other on the right side of the post radial centerline axis 58 and thereby create a value of the bending moment $M_3$ having an arbitrarily specified positive (+) value.

FIG. 9 illustrates an opposite radial differential height H (+) which causes the resultant reaction forces $F_1$ to intersect each other on the left side of the post radial centerline axis 58 and in turn create a negative value of the bending moment $M_4$ (−) which is opposite in sense to the bending moment illustrated in FIG. 7.

FIG. 10 provides a representative plot to show the varying bending moment at the dovetail post neck 46 which varies from a positive value $M_3$ at the rim forward end 32a as shown in FIG. 7 to a negative value designated $M_4$ at the rim aft end 32b. Accordingly, the first and second pressure faces 48, 50 vary in radial height H between their respective reaction lines of contact at the rim aft end 32b from a first magnitude in one sense or direction, i.e. positive (+), at the rim aft end 32b to a second magnitude in a direction or sense, i.e. negative (−), opposite to the first-direction at the rim forward end 32a. In FIG. 9, the first pressure face 48 is radially higher, H(+), than the second pressure face 50. And in FIG. 7, the first pressure face 48 is radially lower, H(−), than the second pressure face 50.

Referring again to FIG. 10, shown in phantom line is the analogous bending moment for a conventional, symmetric dovetail through a similarly sloped and skewed dovetail slot which has a greater magnitude of bending moment $M_1$ (+) in the dovetail post neck at the rim forward end 32a and a smaller but negative moment $M_2$ (−) in the neck at the rim aft end 32b. These bending moments act across the cross sectional area of the respective dovetail post necks 46 at the rim forward end 32a and the rim aft end 32b for creating higher bending stress at the former than at the latter. By radially displacing the first and second pressure faces 48, 50 in accordance with the present invention, the resulting bending moment curve may be shifted downwardly as illustrated in FIG. 10 to decrease the reaction bending moments at the rim forward end 32a from $M_1$ to $M_3$, while simultaneously increasing the bending moment at the rim aft end 32b from $M_2$ to $M_4$ (in a negative sense). The reduced reaction bending moment in the neck 46 at the rim forward end 32a reduces the corresponding bending stress therein, with the increased bending moment in the neck at the rim aft end 32b increasing the bending stress therein. However, the invention allows a better balance in reaction loads, and therefore bending stress, between the rim forward and aft ends 32a, 32b to shift loads and stresses to the aft end 32b wherein the larger dovetail post necks 46 can better carry the loads.

FIG. 10 also illustrates in this exemplary embodiment that the reaction bending moment not only varies from plus to minus values but, therefore, necessarily crosses the zero line with a zero magnitude of the bending moment occurring at an intermediate axial section of the dovetail post neck 46 between the rim forward and aft ends 32a, 32b with an attendant zero magnitude in radial differential height H (=0) as shown in FIG. 8. In the exemplary embodiment illustrated in FIGS. 4 and 8, the intermediate axial section having zero radial height differential is substantially equidistantly spaced between the rim forward and aft ends 32a, 32b, i.e. at the center therebetween, although it could be at other axial locations in other designs. As shown in FIG. 8, the intersecting reaction forces $F_1$ on each dovetail post 40 occurs along the post radial centerline axis 58, therefore resulting in a zero magnitude of reaction bending moment M.

Referring again to FIG. 6, the difference in radial height H between the first and second pressure faces 48, 50 may be obtained by simply translating radially apart the entire faces 48, 50 for varying the radial height H therebetween. As shown in solid line in FIG. 6, the pressure faces 48, 50 are substantially straight with each being inclined relative to the radial centerline axis 58 therebetween at substantially equal but opposite angles A. The first pressure face 48 may be displaced radially upwardly in a positive sense H(+) by translating upwardly the first pressure face 48 relative to an original symmetric dovetail post as indicated by the phantom line at the left side of FIG. 6.

However, instead of translating radially one or the other of the pressure faces 48, 50, either or both pressure faces 48, 50 may be rotated relative to the original symmetrical dovetail post by inclining the respective pressure faces 48, 50 relative to the radial centerline axis 58 therebetween at different and opposite angles for varying the radial height H therebetween. As shown in phantom in the righthand side of FIG. 6, the second pressure face 50 originally having an inclination angle A relative to the centerline axis 58 may be rotated in a counterclockwise direction to provide a reduced inclination angle B relative to the centerline axis 58 which necessarily translates it in part radially upwardly relative to the original, symmetric first and second pressure faces 48, 50. The resultant reaction force $F_1$ will intersect the resultant reaction force $F_i$ of the original undisplaced first pressure face 48 as shown to the left of the centerline axis 58 to create the bending moment M. Of course, combinations of both simple uniform translation between the pressure faces 48, 50 and relative rotation therebetween may be used as desired to provide the desired bending moments M. The effective lengths of the pressure faces 48, 50 may also be varied, in particular where rotation of the pressure face is used for effecting the differential radial height H, since the reaction force changes as the pressure face angle changes as is conventionally known.

Accordingly, the axially varying, asymmetric configuration of the dovetail posts 40 may be utilized in accordance with the present invention to shift bending moments from the dovetail post neck 46 adjacent the rim forward end 32*a* toward the rim aft end 32*b* for significantly reducing the maximum absolute value of the bending stress in the narrower necks 46 adjacent the rim forward end 32*a* while increasing the bending stress in the larger necks 46 adjacent the rim aft end 32*b*. The resulting dovetail slots 38 are straight and may be readily manufactured using a conventional broaching tool. And, the complementary blade dovetail 30 is also, therefore, straight with a constant configuration of the dovetail lobes 52 from its forward end adjacent the airfoil leading edge 26*a* to its aft end adjacent the airfoil trailing edge 26*b* with a constant differential in height L between the respective pressure faces 54, 56 thereof.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A gas turbine engine rotor disk comprising:

an annular rim having an axial centerline axis and axially spaced apart forward and aft ends, said aft end having a larger diameter than said forward end;

said rim having a plurality of circumferentially spaced apart, axially extending straight dovetail slots for receiving therein complementary dovetails of rotor blades, said slots defining a plurality of circumferentially spaced apart dovetail posts; and each of said posts comprising:

a pair of circumferentially oppositely extending lobes defining a maximum circumferential width of said post;

a neck disposed radially below said lobes and defining a minimum circumferential width of said post;

a first pressure face facing radially inwardly from a respective one of said lobes to said neck on a first side of said post for reacting force from said dovetail;

a second pressure face facing radially inwardly from the other one of said lobes to said neck on a second, opposite circumferential side of said post for reacting force from said dovetail; and said first and second pressure faces varying in radial height therebetween from a first magnitude at said rim aft end to a second magnitude at said rim forward end, said second magnitude being less than said first magnitude.

2. A disk according to claim 1 wherein said dovetail slots are axially sloped from said rim forward end to said rim aft end, and circumferentially skewed.

3. A disk according to claim 2 wherein said first and second pressure faces vary in radial height therebetween from said first magnitude in one direction at said rim aft end to a zero magnitude at an intermediate axial section between said rim forward and aft ends, and to said second magnitude in a direction opposite to said first direction at said rim forward end.

4. A disk according to claim 3 wherein said intermediate axial section is substantially equidistantly spaced between said rim forward and aft ends.

5. A disk according to claim 3 wherein each of said post necks increase in width from said rim forward end to said rim aft end.

6. A disk according to claim 5 wherein said dovetail slots have substantially constant widths between said disk post lobes from said rim forward end to said rim aft.

7. A disk according to claim 3 wherein said first and second pressure faces are inclined relative to a radial axis therebetween at substantially equal but opposite angles and are translated radially apart for varying said radial height therebetween.

8. A disk according to claim 3 wherein said first and second pressure faces are inclined relative to a radial axis therebetween at different and opposite angles for varying said radial height therebetween.

9. A disk according to claim 3 in combination with said rotor blades, each of said rotor blades having a longitudinal axis extending radially outwardly from said axial centerline axis and comprising:

an airfoil having a leading edge and a trailing edge;

a dovetail extending from said airfoil and configured for axial entry into a respective one of said dovetail slots;

said dovetail having a pair of circumferentially extending lobes with upwardly facing pressure faces for transmitting loads to said rotor disk; and said dovetail being straight from adjacent said airfoil leading edge to adjacent said airfoil trailing edge and having a substantially constant configuration therebetween, with said pair of pressure faces being longitudinally spaced apart from each other.

10. A gas turbine engine rotor blade having a longitudinal axis and comprising:

an airfoil having a leading edge and a trailing edge;

a dovetail extending from said airfoil and configured for axial entry into a rotor disk having a plurality of circumferentially spaced apart axial dovetail slots defining a plurality of circumferentially spaced apart dovetail posts, each post having a pair of radially inwardly facing, circumferentially spaced apart pressure faces;

said dovetail having a pair of circumferentially extending lobes with upwardly facing pressure faces for transmitting loads to said rotor disk through said dovetail post pressure faces; and said dovetail being straight from adjacent said airfoil leading edge to adjacent said airfoil trailing edge and having a substantially constant configuration therebetween, with said pair of dovetail lobe pressure faces being longitudinally spaced apart from each other.

11. A blade according to claim 10 wherein said dovetail, including said dovetail lobe pressure faces, is sloped upwardly from said airfoil leading edge toward said airfoil trailing edge.

12. A rotor blade for a gas turbine engine rotor disk including:

an annular rim having an axial centerline axis and axially spaced apart forward and aft ends, said aft end having a larger diameter than said forward end;

said rim having a plurality of circumferentially spaced apart, axially extending straight dovetail slots for receiving therein complementary dovetails of rotor blades, said slots defining a plurality of circumferentially spaced apart dovetail posts; and each of said posts comprising:

a pair of circumferentially oppositely extending lobes defining a maximum circumferential width of said post;

a neck disposed radially below said lobes and defining a minimum circumferential width of said post;

a first pressure face facing radially inwardly from a respective one of said lobes to said neck on a first side of said post for reacting force from said dovetail;

a second pressure face facing radially inwardly from the other one of said lobes to said neck on a second, opposite circumferential side of said post for reacting force from said dovetail; and said first and second pressure faces varying in radial height therebetween from a first magnitude at said rim aft end to a second magnitude at said rim forward end, said second magnitude being less than said first magnitude; said rotor blade comprising:

an airfoil having a leading edge and a trailing edge;

a dovetail extending from said airfoil and configured for axial entry into a respective one of said dovetail slots;

said dovetail having a pair of circumferentially extending lobes with upwardly facing pressure faces for transmitting loads to said rotor disk; and said dovetail being straight from adjacent said airfoil leading edge to adjacent said airfoil trailing edge and having a substantially constant configuration therebetween, with said pair of pressure faces being longitudinally spaced apart from each other.

* * * * *